US007187126B2

(12) United States Patent
Kang et al.

(10) Patent No.: US 7,187,126 B2
(45) Date of Patent: Mar. 6, 2007

(54) PLASMA DISPLAY PANEL INCLUDING METAL ELECTRODES FORMED ON TRANSPARENT ELECTRODES

(75) Inventors: Jungwon Kang, Seoul (KR); Woong Kee Min, Jeollanam-do (KR)

(73) Assignee: LG Electronics Inc., Seoul (KR)

( * ) Notice: Subject to any disclaimer, the term of this patent is extended or adjusted under 35 U.S.C. 154(b) by 111 days.

(21) Appl. No.: 10/807,435

(22) Filed: Mar. 24, 2004

(65) Prior Publication Data

US 2004/0189202 A1 Sep. 30, 2004

(30) Foreign Application Priority Data

Mar. 25, 2003 (KR) ..... 10-2003-0018451
Mar. 25, 2003 (KR) ..... 10-2003-0018452
Jun. 2, 2003 (KR) ..... 10-2003-0035338

(51) Int. Cl.
*H01J 17/49* (2006.01)
*G09F 9/302* (2006.01)

(52) U.S. Cl. ..... 313/584; 313/582

(58) Field of Classification Search ..... 313/584, 313/585, 587
See application file for complete search history.

(56) References Cited

U.S. PATENT DOCUMENTS 6,031,329 A * 2/2000 Nagano ..... 313/582
6,531,819 B1 * 3/2003 Nakahara et al. ..... 313/584
6,720,736 B2 * 4/2004 Lee et al. ..... 315/169.3
6,791,263 B2 * 9/2004 Su et al. ..... 313/582
2005/0093445 A1 * 5/2005 Min et al. ..... 313/582

* cited by examiner

*Primary Examiner*—Nimeshkumar D. Patel
*Assistant Examiner*—Natalie K. Walford
(74) *Attorney, Agent, or Firm*—Fleshner & Kim, LLP

(57) ABSTRACT

A plasma display panel may be provided having metal and auxiliary metal electrodes formed such that brightness and efficiency are improved. A plasma display panel may include transparent ITO electrodes and metal electrodes. The transparent ITO electrodes are spaced in parallel to each other at a predetermined distance within a discharge cell. The metal electrodes are formed on the transparent ITO electrodes and in parallel to the transparent ITO electrodes. Central portions of the metal electrodes are closer to a central portion of the discharge cell than central portions of the transparent ITO electrodes.

25 Claims, 12 Drawing Sheets

【Fig. 1】
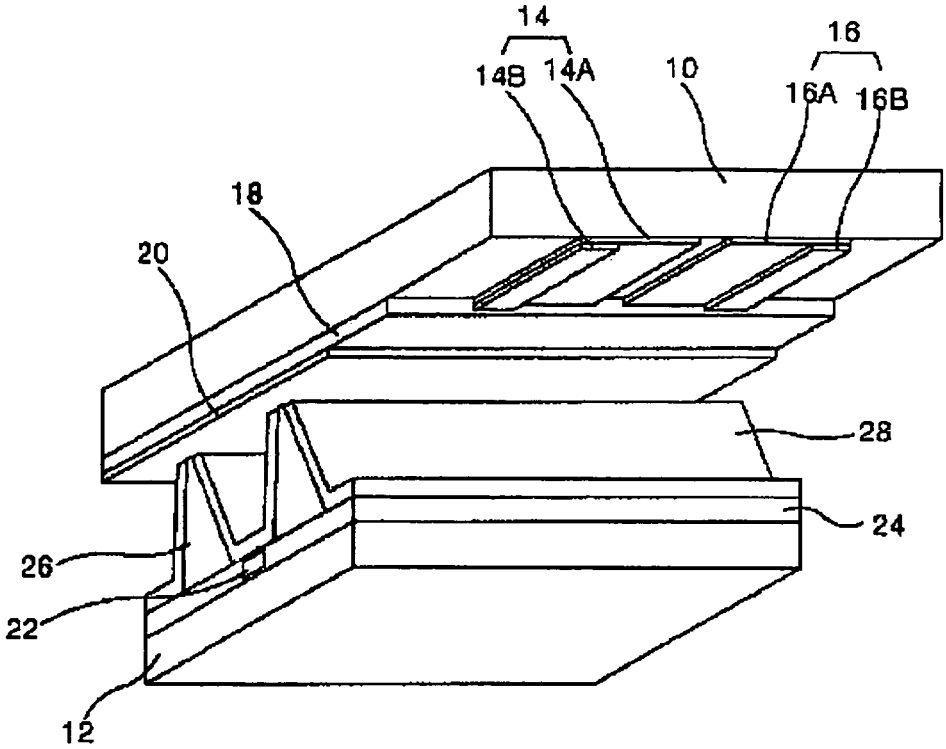
【Fig. 2】
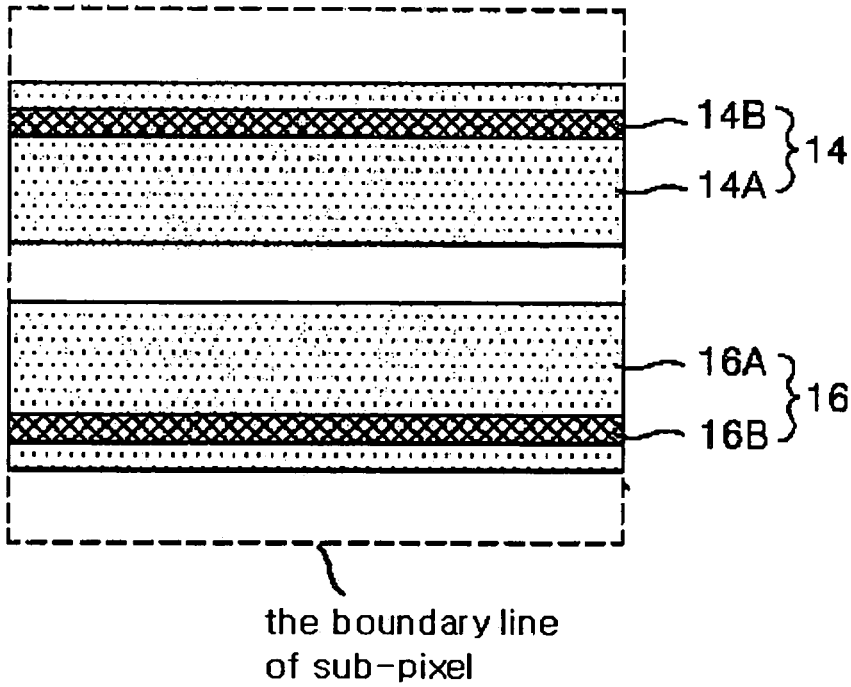

【Fig. 3】
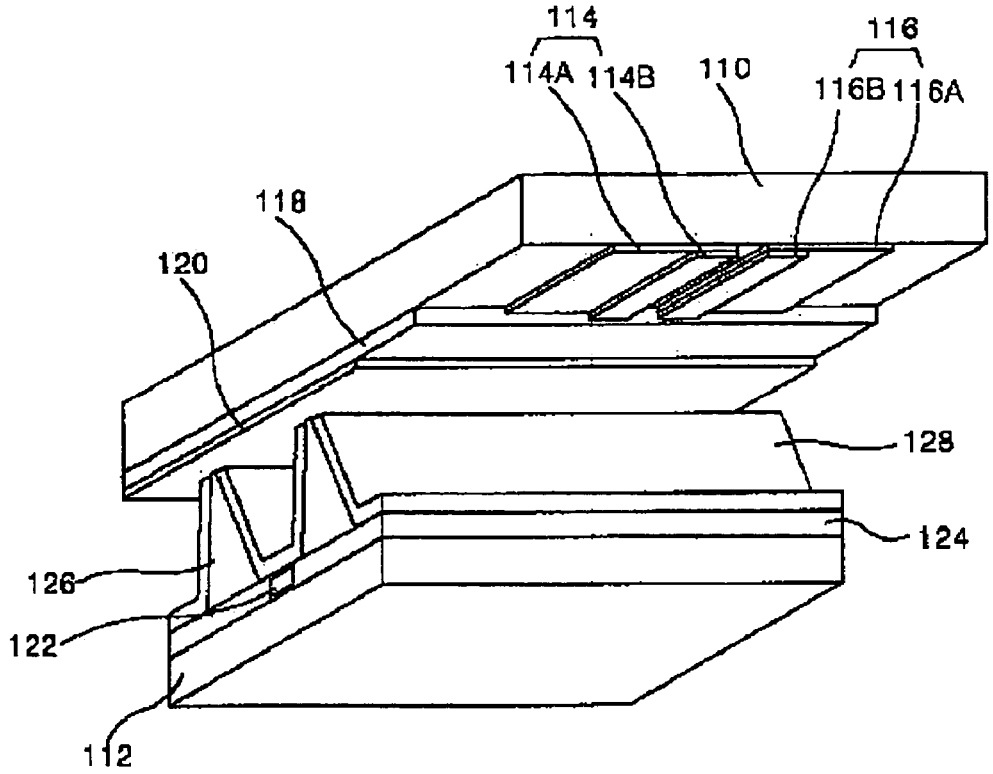
【Fig. 4】
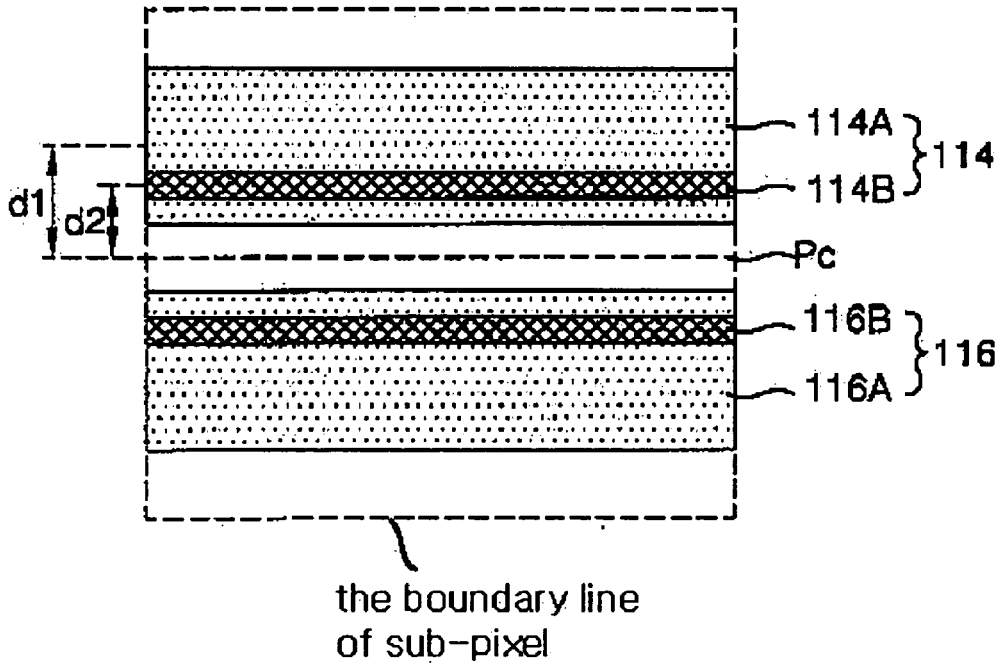

【Fig. 5】
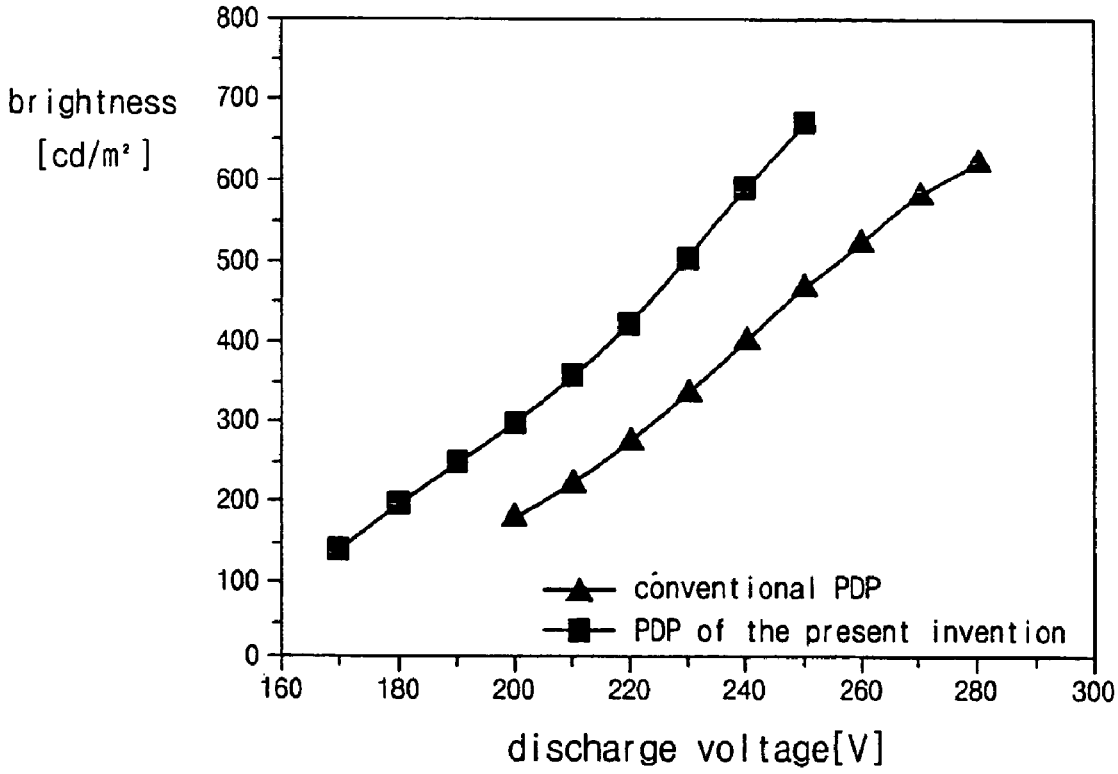

【Fig. 6】
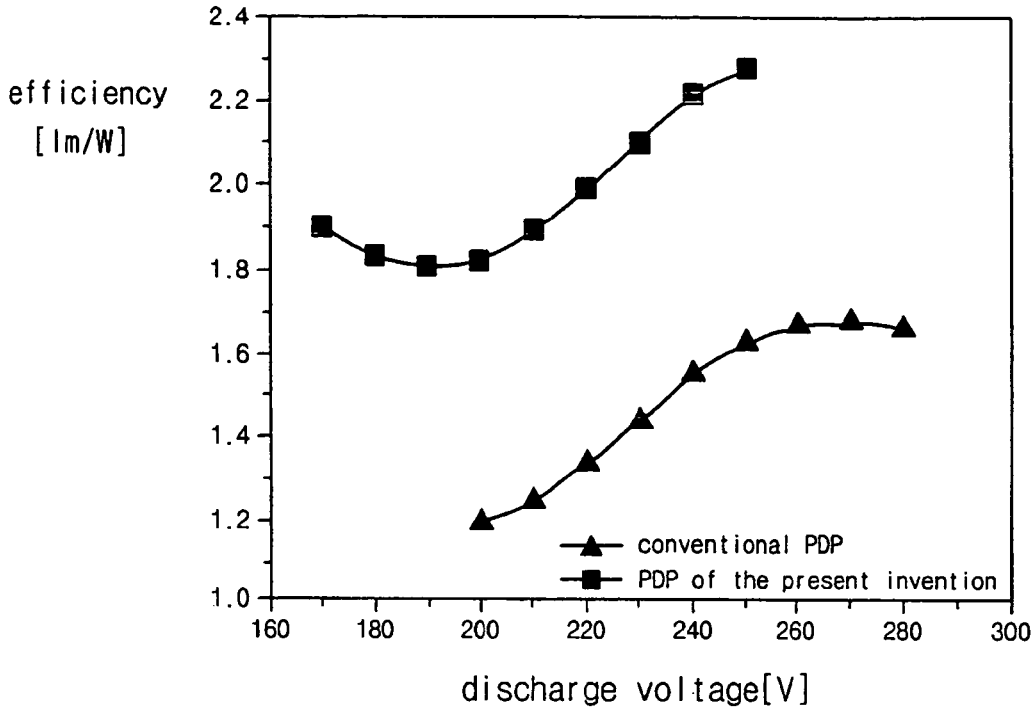
【Fig. 7】
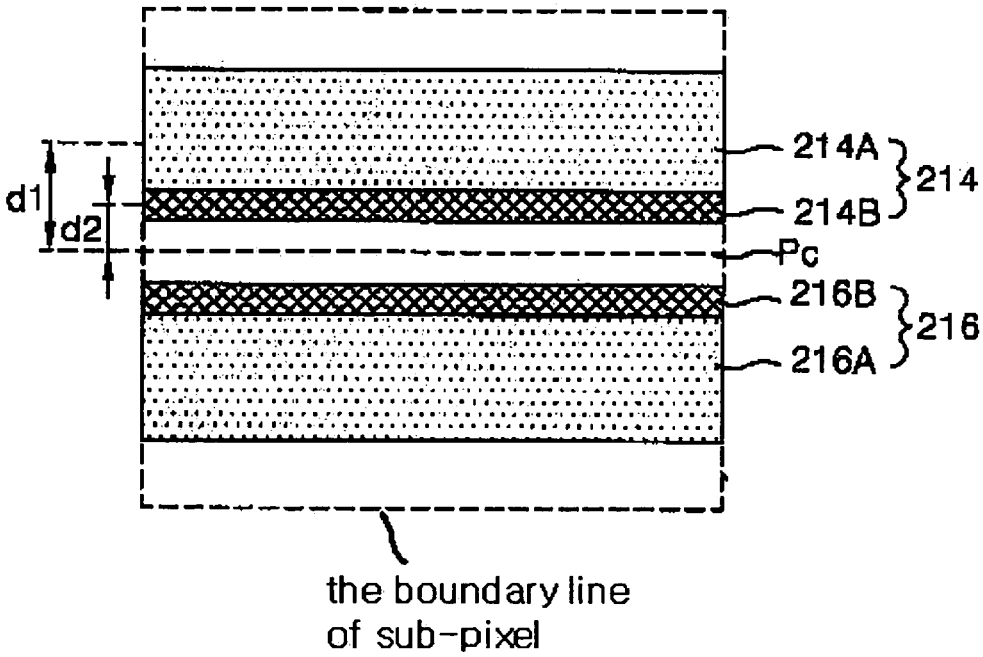

【Fig. 8a】
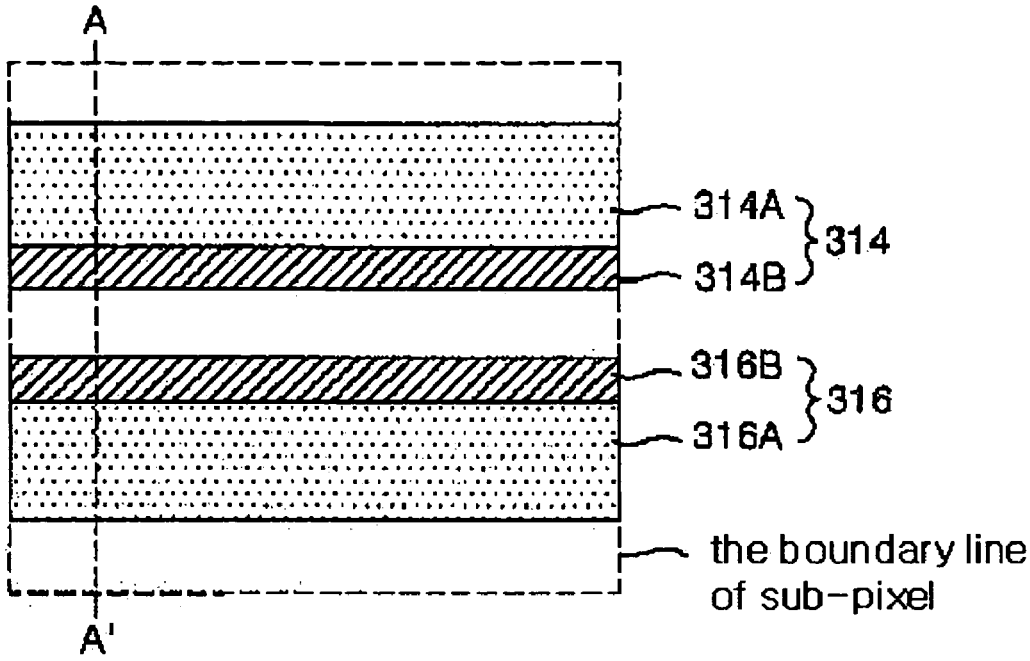
【Fig. 8b】
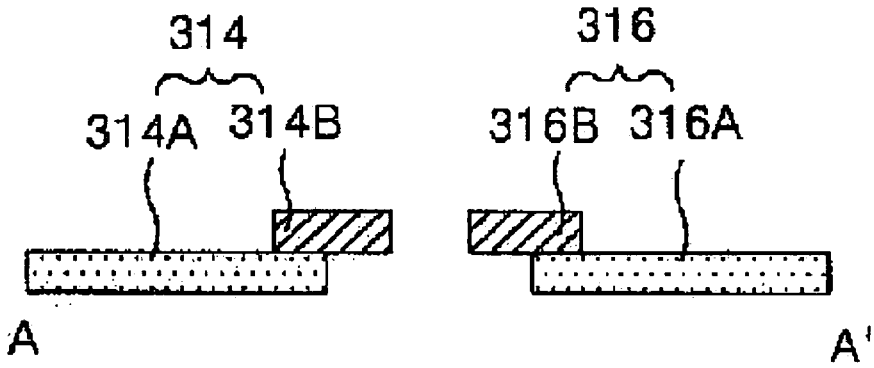

【Fig. 9】
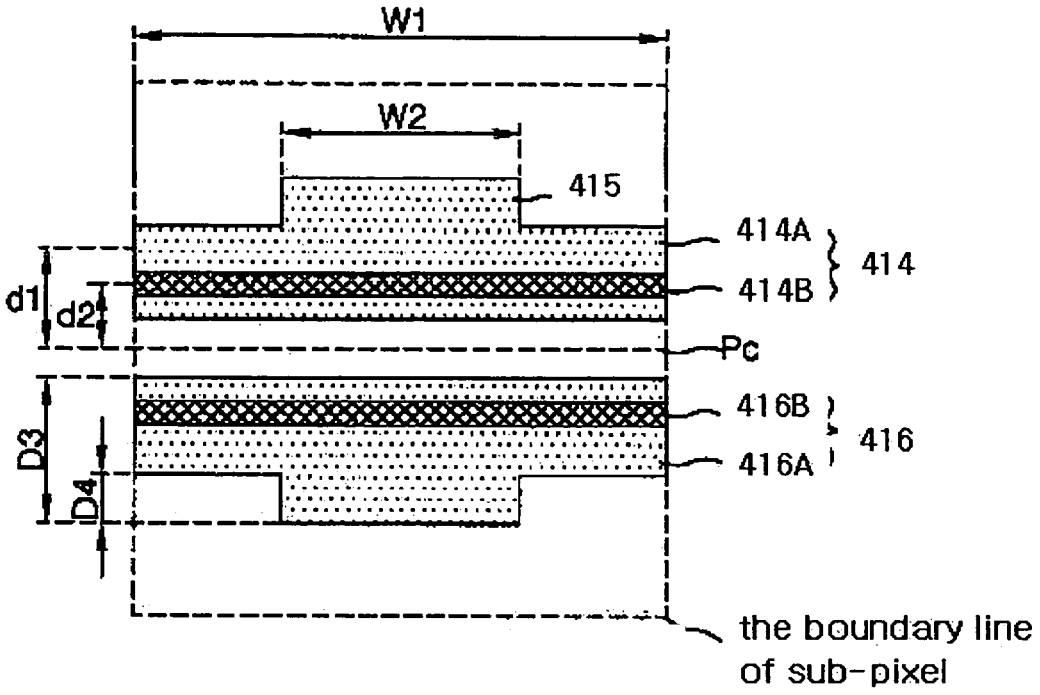
【Fig. 10】
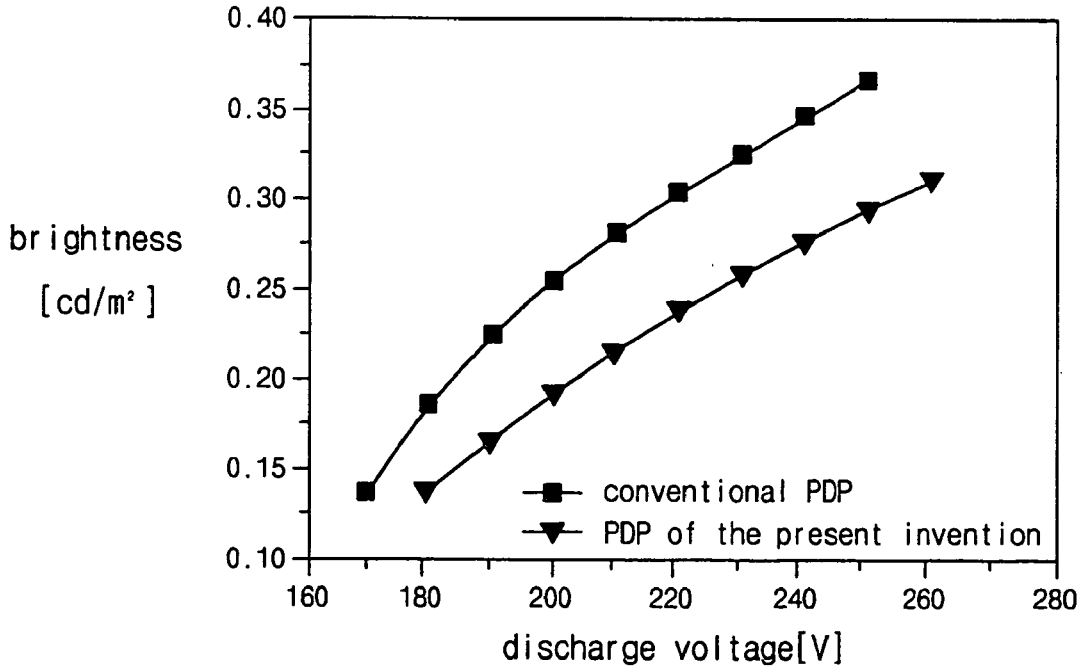

【Fig. 1 1】
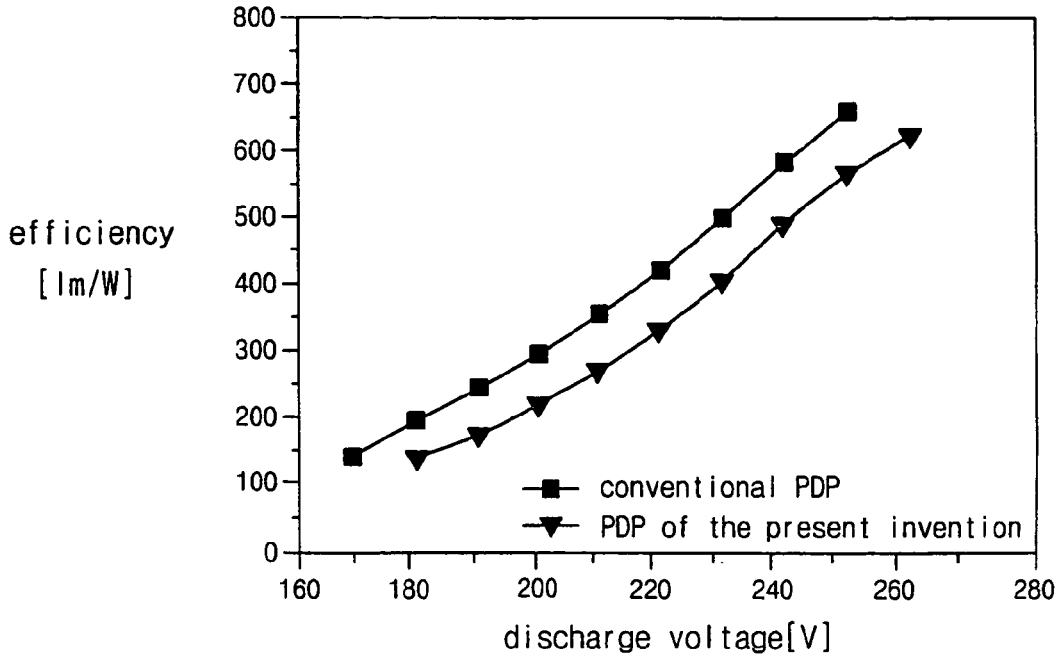
【Fig. 1 2】
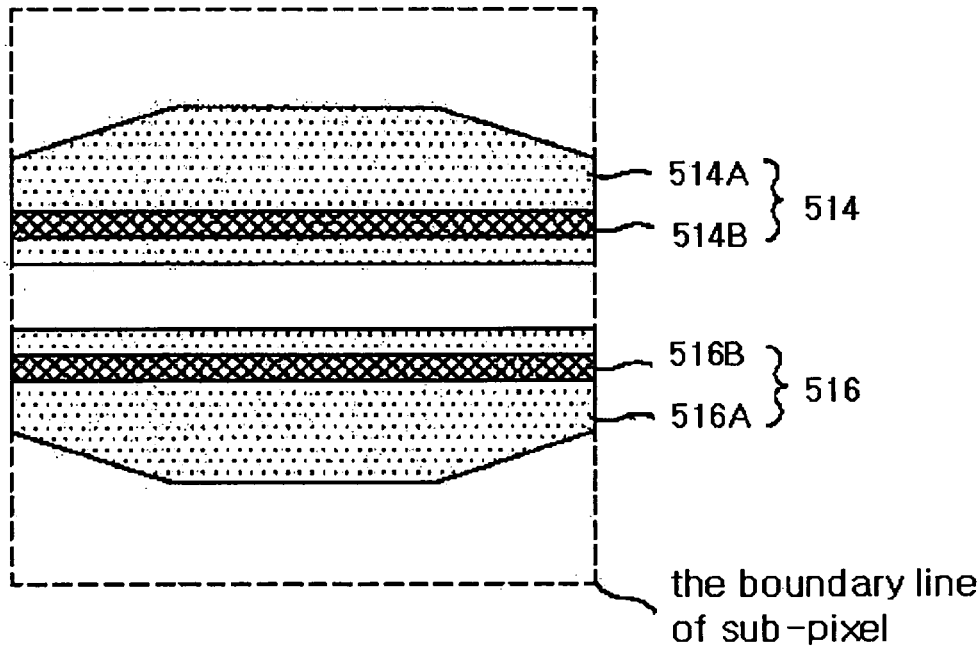

【Fig. 1 3】
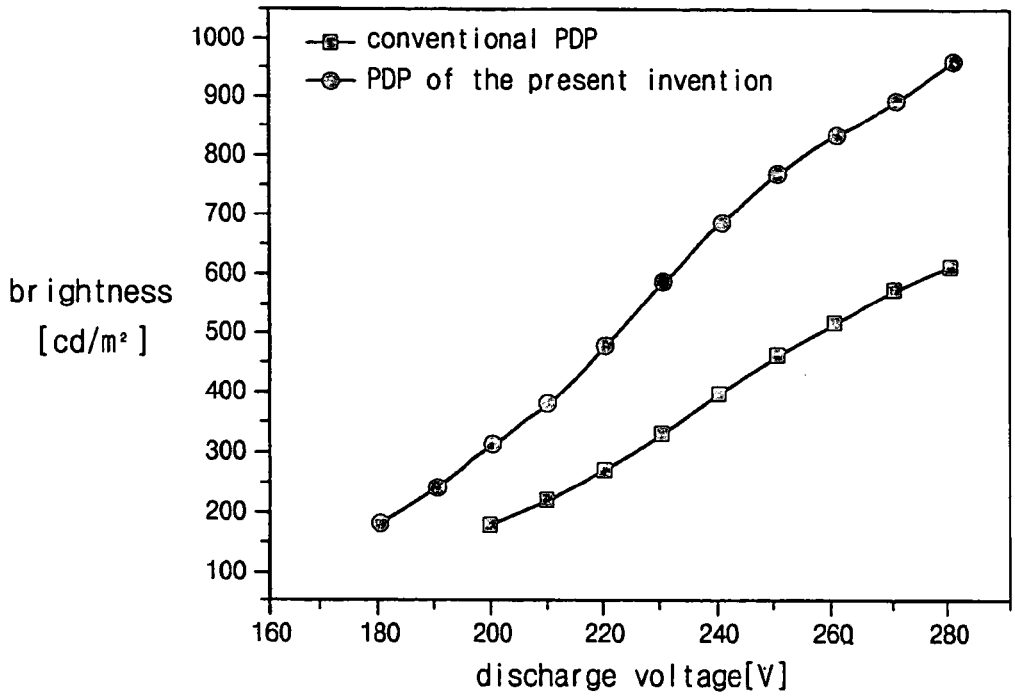
【Fig. 1 4】
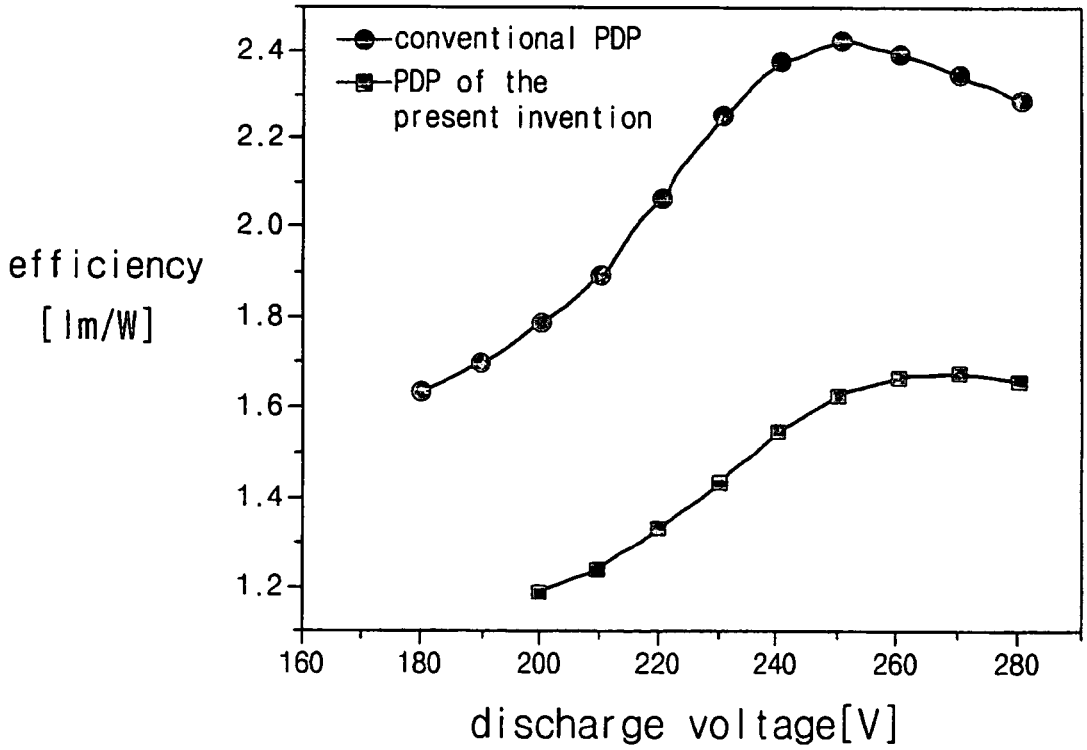

【Fig. 1 5】
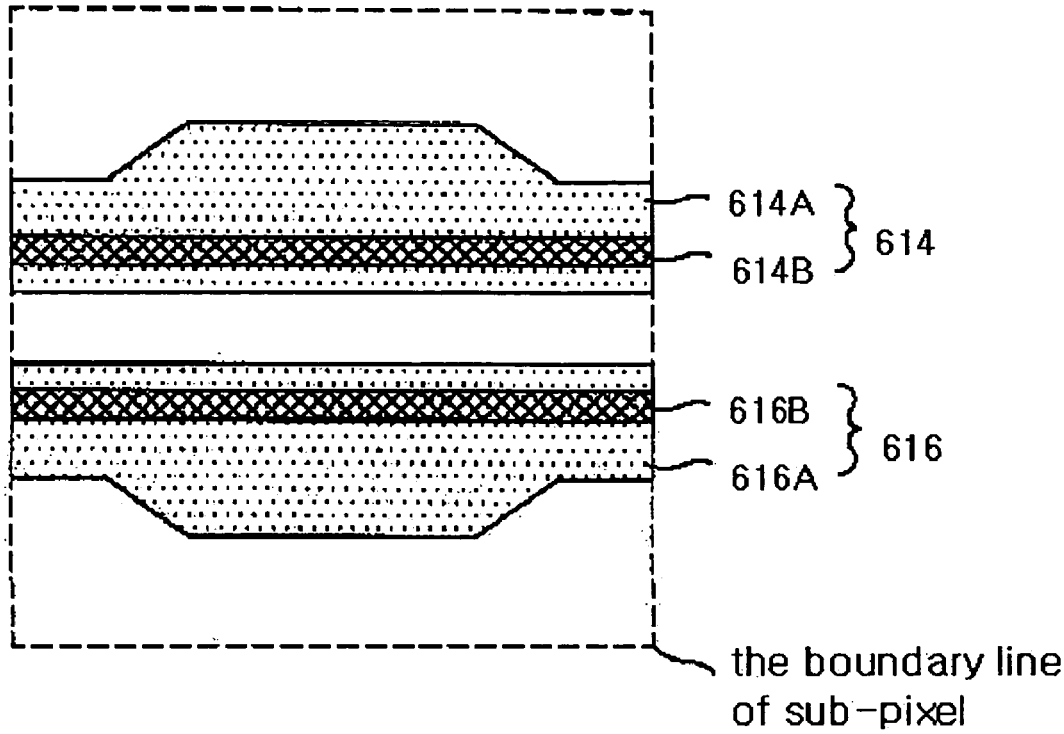
【Fig. 1 6】
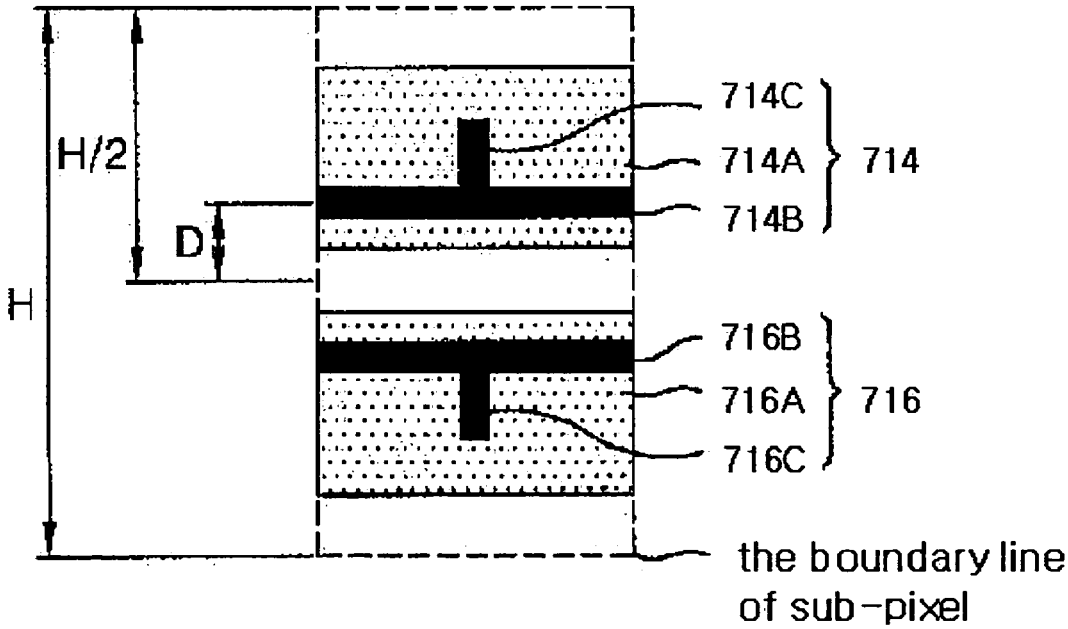

【Fig. 17】
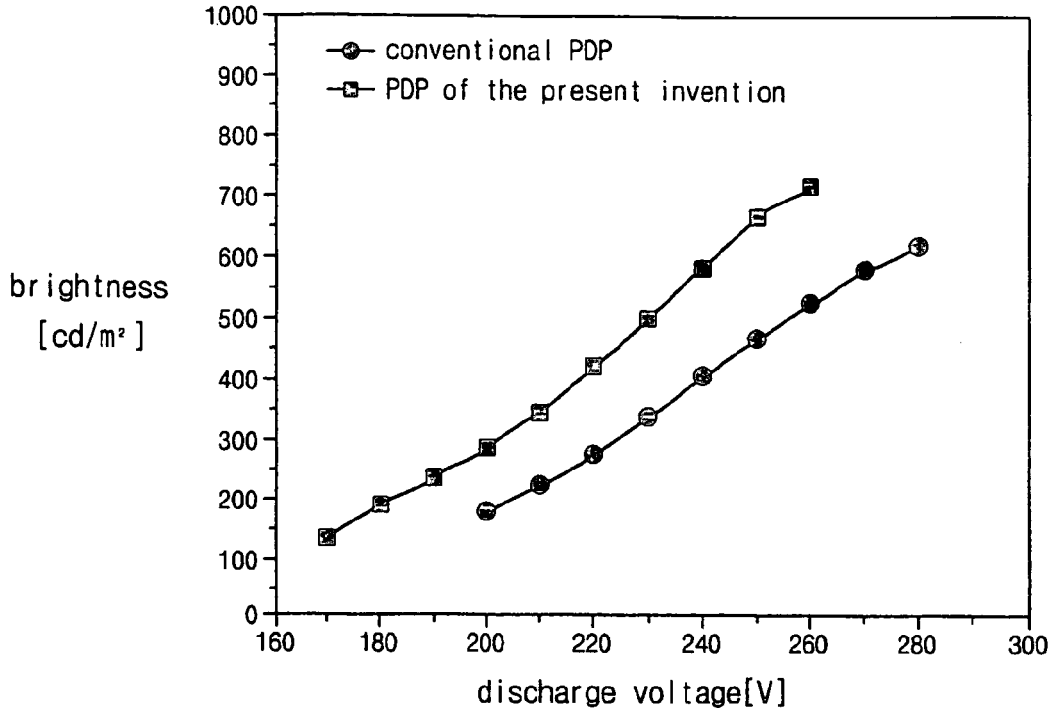
【Fig. 18】
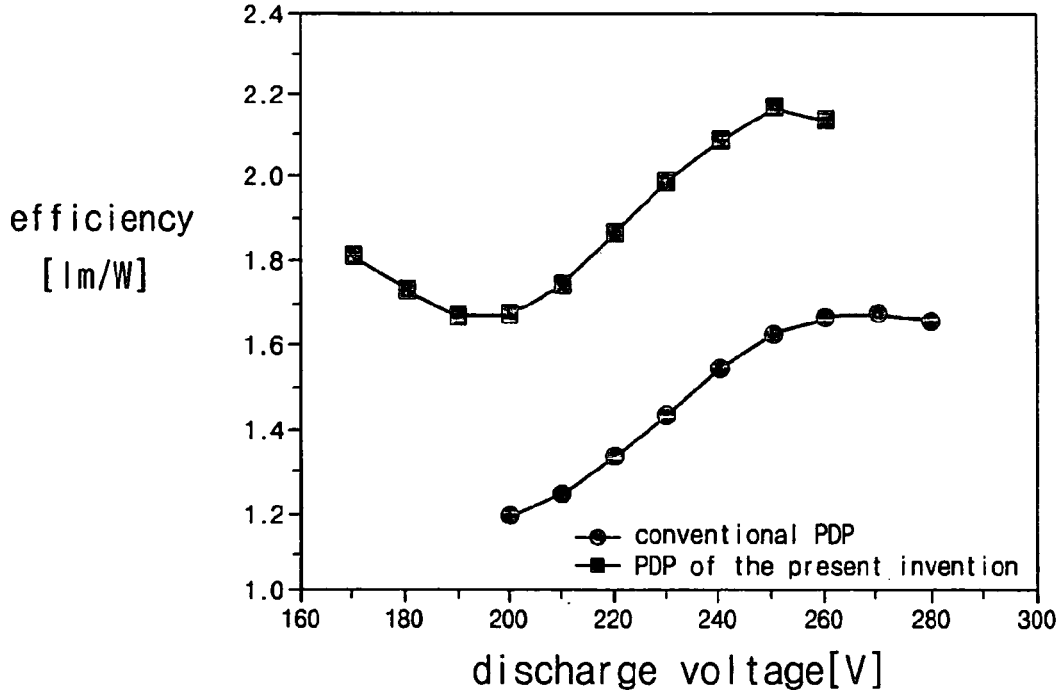

【Fig. 19】
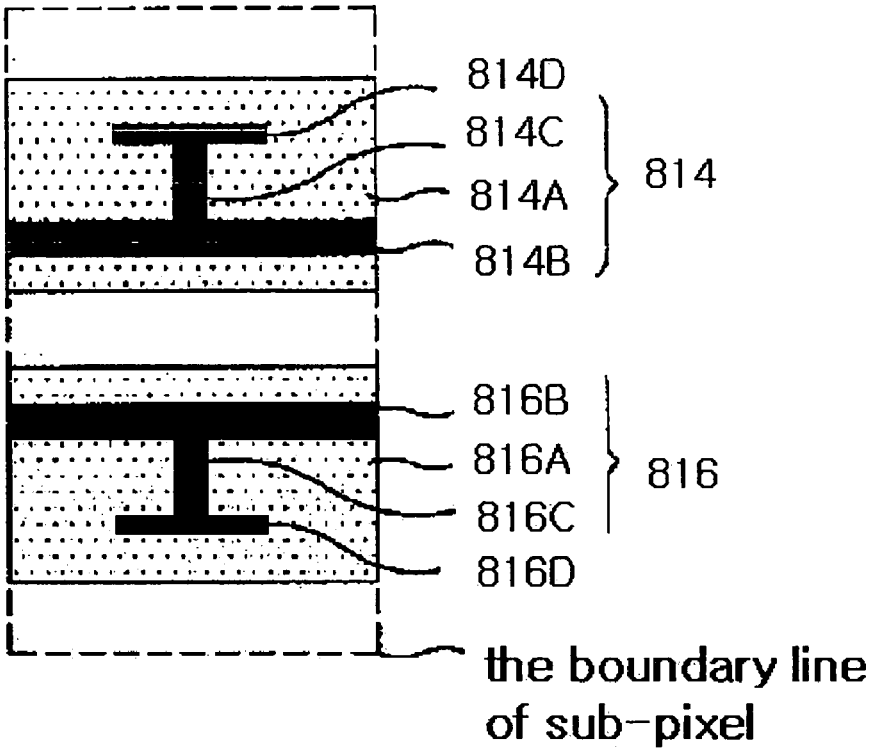
【Fig. 20】
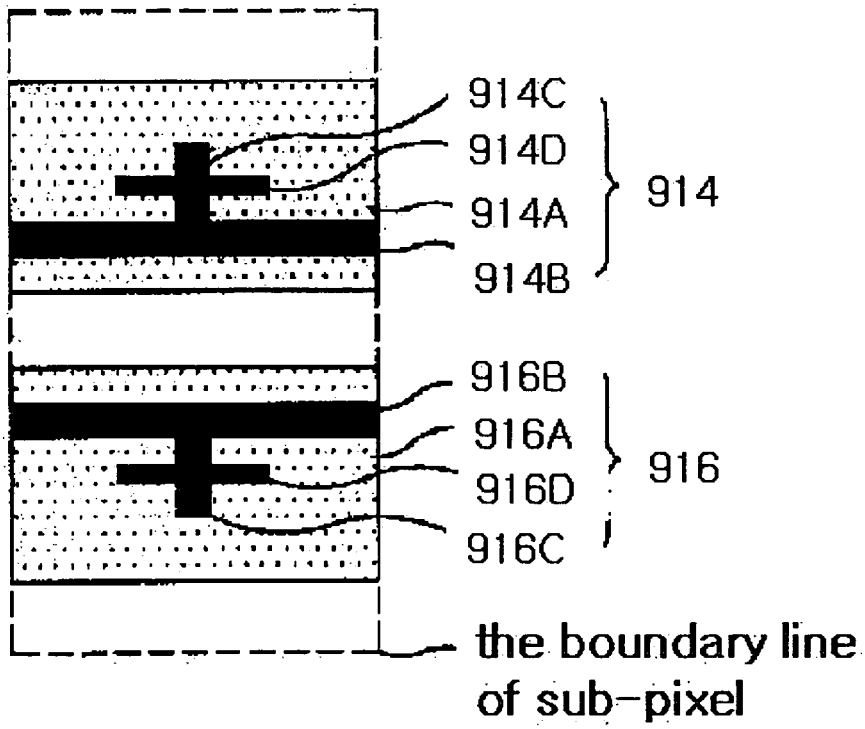

【Fig. 21】
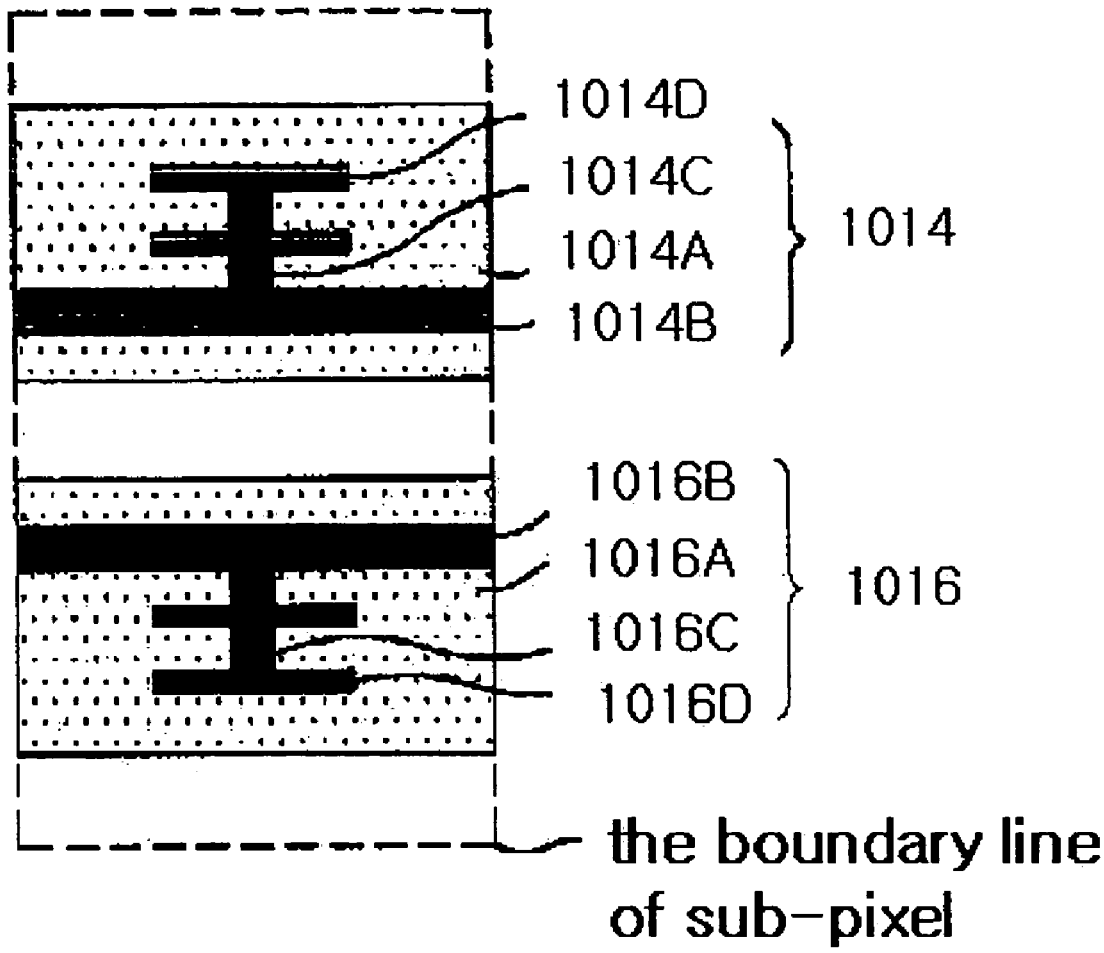

PLASMA DISPLAY PANEL INCLUDING METAL ELECTRODES FORMED ON TRANSPARENT ELECTRODES

TECHNICAL FIELD

The present invention relates to a plasma display panel and more specifically to a plasma display panel in which metal and auxiliary metal electrodes are formed such that brightness and efficiency are improved.

BACKGROUND OF THE INVENTION

FIG. 1 is a perspective view illustrating a discharge cell of a general AC plasma display panel arranged in matrix shape.

As shown in FIG. 1, a conventional PDP comprises a front substrate 10 and rear substrate 12. A pair of sustain electrode 14, 16, upper dielectric layer 18 and protective layer 20 are gradually formed on the front substrate 10, and address electrodes 22, lower dielectric layer 24 and barrier ribs 26 and phosphor layer 28 are gradually formed on the rear substrate 12. The front substrate 10 and the rear substrate 12 are spaced in parallel to each other at a predetermined distance by barrier ribs 26.

Wall charges occurred upon the plasma discharge is accumulated on the upper dielectric layer 18 and the lower dielectric layer 24. The protection layer 20 serves to prevent damage of the upper dielectric layer 18 due to sputtering generated upon the plasma discharge and to increase emission efficiency of secondary electrons. The protection layer 20 is usually formed using magnesium oxide (MgO).

The address electrodes 22 are formed in the direction intersecting a pair of sustain electrodes 14, 16. A data signal is supplied for the address electrodes 22 to select a cell that is displayed.

The barrier ribs 26 are formed in parallel to the address electrode 22 and serves to prevent ultraviolet rays and a visible ray generated due to the discharge from leaking toward neighboring discharge cells. The barrier ribs 26 may be existed or not a boundary line of sub-pixel.

The phosphor layer 28 is excited by ultraviolet rays generated upon the plasma discharge to generate a visible ray of one of red, green and blue. Inert mixed gases such as He+Xe, Ne+Xe and He+Ne+Xe for discharge are inserted into a discharge space of the discharge cell formed between the upper/lower substrates 10, 12.

A pair of sustain electrode 14, 16 comprises scan electrodes 14 and sustain electrodes 16. A scan signal for scanning of the panel is supplied for scan electrodes 14 and a sustain signal for maintaining discharge of a selected cell is supplied for sustain electrodes.

A pair of sustain electrode 14, 16 comprises transparent ITO electrodes 14A, 16A, which are stripe pattern, are made of transparent material in order to transmit a visible ray and have a wide width relatively, and metal electrodes 14B, 16B, which compensate a resistance of transparent ITO electrodes 14A, 16A and have a narrow width relatively. Each of the transparent ITO electrodes of a pair of sustain electrodes 14, 16 is opposite to each other at a predetermined distance. Further, metal electrodes 14B, 16B are formed in parallel to the transparent ITO electrodes 14A, 16A and formed on a verge of the transparent ITO electrodes 14A, 16A, respectively. Namely, metal electrodes 14B, 16B are formed on outside verge of the transparent ITO electrodes 14A, 16A.

A PDP cell of this structure sustains a discharge according to surface discharge between a pair of sustain electrodes 14, 16 after being selected by opposite discharge between the address electrode 22 and the scan electrode 14. In the PDP cell, a visible ray is emitted to an outside of cell as radiating phosphors 28 by ultraviolet rays which are generated while the sustain discharge occurs. As a result, the PDP having cells displays an image. In this case, the PDP realizes a gray scale by controlling the discharge sustaining period, i.e. the number of sustain discharge according to a video data.

In the conventional PDP, Xe inert gas excites phosphors 28 using a vacuum ultraviolet generated by changing from excited state to ground state according to gas discharge. Therefore, as a content of Xe is much, a quantity of vacuum ultraviolet rays generated upon the gas discharge and the efficiency of the PDP increase. However, the increase of Xe is caused by rising discharge starting voltage and discharge sustaining voltage between sustain electrodes.

Furthermore, in the conventional PDP, the discharge starting voltage and the discharge sustaining voltage is raised because the metal electrodes 14B, 16B are formed on the outside verge of the transparent ITO electrodes 14A, 16A, respectively. Also, the brightness and efficiency of the conventional PDP are decreased.

That is, the conventional PDP structure has a difficulty in increasing brightness and efficiency without any problem such as the structure of electrodes within the discharge cell.

SUMMARY OF THE INVENTION

Accordingly, the present invention has been made in view of the above problems, and it is an object of the present invention to provide a plasma display panel for increasing brightness and efficiency and improving a stability of discharge.

A plasma display panel according to a first embodiment of the present invention comprises: transparent ITO electrodes which are spaced in parallel to each other at a predetermined distance within a discharge cell; metal electrodes which are formed on said transparent ITO electrodes and in parallel to said transparent ITO electrodes so that are positioned in the direction of opposite sides of said transparent ITO electrodes, respectively.

A plasma display panel according to a second embodiment of the present invention comprises: transparent ITO electrodes which are spaced in parallel to each other at a predetermined distance within a discharge cell and are patterned so that a part of said transparent ITO electrodes is different in width, respectively; and metal electrodes which are formed on said transparent ITO electrodes and in parallel to said transparent ITO electrodes so that are positioned in the direction of opposite sides of said transparent ITO electrodes, respectively.

A plasma display panel according to a third embodiment of the present invention comprises: transparent ITO electrodes which are spaced in parallel to each other at a predetermined distance within a discharge cell; metal electrodes which are formed on said transparent ITO electrodes and in parallel to said transparent ITO electrodes so that are positioned in the direction of opposite sides of said transparent ITO electrodes, respectively; and projecting metal electrodes which are jutted from said metal electrodes, respectively.

BRIEF DESCRIPTION OF THE DRAWINGS

FIG. 1 is a perspective view illustrating a discharge cell of a plasma display panel of the prior art.

FIG. 2 is a plane view illustrating a pair of sustain electrodes shown in FIG. 1.

FIG. 3 is a perspective view illustrating a discharge cell of a plasma display panel according to a first embodiment of the present invention.

FIG. 4 is a plane view illustrating a pair of sustain electrodes according to the first embodiment of the present invention shown in FIG. 3.

FIG. 5 is a graph showing comparison of brightness between the first embodiment of the present invention and the prior art with respect to discharge voltage.

FIG. 6 is a graph showing comparison of efficiency between the first embodiment of the present invention and the prior art with respect to discharge voltage.

FIG. 7 is a plane view illustrating a pair of sustain electrodes according to a modification of the first embodiment.

FIG. 8*a* is a plane view illustrating a pair of sustain electrodes according to another modification of a first embodiment.

FIG. 8*b* is a cross-sectional view of a pair of sustain electrodes of FIG. 8*a* taken along a line A–A'.

FIG. 9 is a perspective view illustrating a discharge cell of a plasma display panel according to a second embodiment of the present invention.

FIG. 10 is a graph showing comparison of brightness between the second embodiment of the present invention and the prior art with respect to discharge voltage.

FIG. 11 is a graph showing comparison of efficiency between the second embodiment of the present invention and the prior art with respect to discharge voltage.

FIG. 12 is a plane view illustrating a pair of sustain electrodes according to a modification of the second embodiment.

FIG. 13 is a graph showing comparison of brightness between a modification of the second embodiment of the present invention and the prior art with respect to discharge voltage.

FIG. 14 is a graph showing comparison of efficiency between a modification of the second embodiment of the present invention and the prior art with respect to discharge voltage.

FIG. 15 is a plane view illustrating a pair of sustain electrodes according to another modification of the second embodiment.

FIG. 16 is a plane view illustrating a pair of sustain electrodes according to a third embodiment of the present invention.

FIG. 17 is a graph showing comparison of brightness between the third embodiment of the present invention and the prior art with respect to discharge voltage.

FIG. 18 is a graph showing comparison of efficiency between the third embodiment of the present invention and the prior art with respect to discharge voltage.

FIG. 19 is a plane view illustrating a pair of sustain electrodes according to a modification of the third embodiment.

FIG. 20 is a plane view illustrating a pair of sustain electrodes according to another modification of the third embodiment.

FIG. 21 is a plane view illustrating a pair of sustain electrodes according to the other modification of the third embodiment.

DETAILED DESCRIPTION OF THE INVENTION

Reference will now be made in detail to the preferred embodiments of the present invention, examples of which are illustrated in the accompanying drawings.

The First Embodiment

FIG. 3 is a perspective view illustrating a discharge cell of a plasma display panel according to a first embodiment of the present invention, FIG. 4 is a plane view illustrating a pair of sustain electrodes according to the first embodiment of the present invention shown in FIG. 3.

As shown in FIG. 3, a plasma display panel according to the first embodiment of the present invention has a front substrate 110 and rear substrate 112. A pair of sustain electrodes 114, 116, upper dielectric layer 118 and protective layer 120 are gradually formed on the front substrate 110, and address electrodes 122, lower dielectric layer 124 and barrier ribs 126 and phosphor layer 128 are gradually formed on the rear substrate 112. The front substrate 110 and the rear substrate 112 are spaced in parallel to each other at a predetermined distance by barrier ribs 126.

A pair of sustain electrode 114, 116 is composed of scan electrodes 114 and sustain electrodes 116. A scan signal for scanning of the panel is supplied for scan electrodes 114 and a sustain signal for maintaining discharge of a selected cell is supplied for sustain electrodes 116.

According to the first embodiment of the present invention, the sustain electrodes 114, 116 are consisted of the transparent ITO electrodes 114A, 116A and the metal electrodes 114B, 116B. The transparent ITO electrodes 114A, 116A have a stripe pattern of a wide width relatively and are made of transparent material in order to transmit a visible ray. The metal electrodes 114B, 116B have a stripe pattern of a narrow width relatively and are made of material having a good conductivity in order to compensate a conductivity of transparent ITO electrodes 114A, 116A.

Each of the transparent ITO electrodes 114A, 116A of a pair of sustain electrodes 114, 116 are opposite to each other at a predetermined distance.

Preferably, the position of each of the metal electrodes 114B, 116B satisfies the following the equation 1.

$$d2 < d\tfrac{1}{2} \qquad \text{[Equation.1]}$$

wherein d1 represents a distance between a central portion of the transparent ITO electrodes 114A, 116A and a center line(Pc) of the discharge cell, d2 represents a distance between a central portion of the metal electrodes 114B, 116B and a center line(Pc) of the discharge cell.

In the PDP according to the first embodiment of the present invention, the discharge starting voltage and discharge sustaining voltage are decreased and the brightness and efficiency are increased at this time of the discharge, although the contents of Xe inert gas increases.

In the concrete, since the distance between the metal electrodes 114B, 116B is near, the strong electric field generates at the central portion of the discharge cell, at this time of the discharge. And, the discharge starting voltage and discharge sustaining voltage are decreased by the strong electric field generated at the central portion of the discharge cell.

FIG. 5 is a brightness graph which compares a first embodiment of the present invention with a prior art and FIG. 6 is an efficiency graph which compares a first embodiment of the present invention with a prior art.

As shown in FIG. 5 and FIG. 6, the brightness of the PDP according to the first embodiment of the present invention is improved approximately 40% to 60% as compared to the conventional PDP at the same discharge voltage, and the efficiency of the PDP according to the first embodiment of the present invention is improved approximately 40% to 60% as compared to the conventional PDP at the same discharge voltage. Further, as the discharge starting voltage and the discharge delay time are decreased, the stability of discharge can be improved.

FIG. 7 is a plane view illustrating a pair of sustain electrodes according to a modification of the first embodiment.

The description of the same elements with the first embodiment of the present invention shown in FIG. 3 is omitted.

According to a modification of the first embodiment of the present invention, sustain electrodes 214, 216 are consisted of transparent ITO electrodes 214A, 216A and metal electrodes 214B, 216B on the transparent ITO electrodes 214A, 216A.

The transparent ITO electrodes 214A, 216A have a stripe pattern of a wide width relatively and are made of transparent material in order to transmit a visible ray.

Each of the metal electrodes 214B, 216B has a stripe pattern which has a narrower width than the transparent ITO electrodes 214A, 216A and is formed in the direction of a central portion of the transparent ITO electrodes 214A, 216A from a opposite sides of the transparent ITO electrodes 214A, 216A. Further, a position of the metal electrodes 214B, 216B satisfies the above equation 1 and the metal electrodes 214B, 216B are made of material having a good conductivity in order to compensate a conductivity of transparent ITO electrodes 214A, 216A.

That is, a distance between the metal electrodes 214B, 216B according to a modification of the first embodiment is smaller than a distance between the metal electrodes 114B, 116B according to the first embodiment. Therefore, a strong electric field is induced at the central portion (Pc) of the discharge cell when the plasma discharge occurs.

A characteristic of the brightness and efficiency is similar to those of the first embodiment shown in FIG. 5 and FIG. 6.

FIG. 8*a* is a plane view illustrating a pair of sustain electrodes according to another modification of a first embodiment, and FIG. 8*b* is a cross-sectional view of a pair of sustain electrodes of FIG. 8*a* taken along a line A–A'.

The description of the same elements with the first embodiment of the present invention shown in FIG. 3 is omitted. A pair of sustain electrode 314, 316 are composed of scan electrodes 314 and sustain electrodes 316. The sustain electrodes 314, 316 are consisted of the transparent ITO electrodes 314A, 316A, and the metal electrodes 314B, 316B. Each of the transparent ITO electrodes 314A, 316A of a pair of sustain electrodes 314, 316 is opposite to each other at a predetermined distance.

Transparent ITO electrodes 314A, 316A have a stripe pattern of a wide width relatively and are made of transparent material in order to transmit a visible ray.

Each of the metal electrodes 314B, 316B has a stripe pattern which has a narrower width than the transparent ITO electrodes 314A, 316A. A part of each of the metal electrodes 314B, 316B is formed on an opposite sides of the transparent ITO electrodes 314A, 316A. Further, a position of the metal electrodes 314B, 316B satisfies the above equation 1 and the metal electrodes 314B, 316B are made of material having a good conductivity in order to compensate a conductivity of transparent ITO electrodes 314A, 316A.

That is, a distance between the metal electrodes 314B, 316B according to another modification of the first embodiment is smaller than a distance between the metal electrodes according to the first embodiment. Therefore, a strong electric field is induced at the central portion (Pc) of the discharge cell when the plasma discharge occurs.

Furthermore, a characteristic of the brightness and efficiency is similar to those of the first embodiment shown in FIG. 5 and FIG. 6.

The Second Embodiment

The description of the same elements with the first embodiment of the present invention shown in FIG. 3 is omitted.

FIG. 9 is a perspective view illustrating a discharge cell of a plasma display panel according to a second embodiment of the present invention.

Sustain electrodes 414, 416 are consisted of transparent ITO electrodes 414A, 416A and metal electrodes 414B, 416B on the transparent ITO electrodes 414A, 416A. The transparent ITO electrodes 414A, 416A are opposite to each other at a predetermined distance.

The transparent ITO electrodes 414A, 416A have a stripe pattern of a wide width relatively and are made of transparent material in order to transmit a visible ray. And, each of the transparent ITO electrodes 414A, 416A is a"T" shape, namely both edges are patterned in a shape of quadrangle. Wherein the pattern is a part which an influence of brightness is little.

Preferably, the "T" shape of each of the transparent ITO electrodes 414A, 416A satisfies the following the equation 2 and 3.

$$0.2\times W1<W2<0.8\times W1 \quad \text{[Equation. 1]}$$

wherein W1 represents a horizontal length of a discharge cell, W2 represents a horizontal length of a part of a narrow area of the transparent ITO electrodes 414A, 416A, relatively.

$$0.2\times D3<D4<0.8\times D3 \quad \text{[Equation 3]}$$

wherein D3 represents a width of the transparent ITO electrodes 414A, 416A, D4 represents a width of a part of a narrow area of the transparent ITO electrodes 414A, 416A, relatively.

Each of the metal electrodes 414B, 416B has a stripe pattern which has a narrower width than the transparent ITO electrodes 414A, 416A and is formed in the direction of a central portion of the transparent ITO electrodes 414A, 416A from an opposite sides of the transparent ITO electrodes 414A, 416A. Further, a position of the metal electrodes 414B, 416B satisfies the above equation I and the metal electrodes 414B, 416B are made of material having a good conductivity in order to compensate a conductivity of transparent ITO electrodes 414A, 416A.

In the PDP according to the second embodiment of the present invention, the discharge starting voltage and discharge sustaining voltage are decreased and the brightness and efficiency are increased at this time of the discharge, although the contents of Xe inert gas increases. Further, as an area ratio of the transparent ITO electrodes 414A, 416A in comparison with a discharge cell is decreased, a consumption power is reduced and a radiation efficiency is improved.

Therefore, as shown in FIG. 10, a current density according to the second embodiment of the present invention is decreased approximately 20% to 25% in comparison with the conventional PDP and a reductive width of the current density is larger as a discharge voltage is high.

As shown in FIG. 11, the efficiency of the PDP according to the second embodiment of the present invention is improved as compared to the conventional PDP at the same discharge voltage.

FIG. 12 is a plane view illustrating a pair of sustain electrodes according to a modification of the second embodiment.

Sustain electrodes 514, 516 are consisted of transparent ITO electrodes 514A, 516A and metal electrodes 514B, 516B on the transparent ITO electrodes 514A, 516A. The transparent ITO electrodes 514A, 516A are opposite to each other at a predetermined distance.

The transparent ITO electrodes 514A, 516A have a stripe pattern of a wide width relatively and are made of transparent material in order to transmit a visible ray. And, each of the transparent ITO electrodes 514A, 516A is consisted of an upper portion of a first width and a lower portion of a second width. Namely, both edges are patterned in a shape of triangle. Wherein the pattern is a part which an influence of brightness is little. In result, each of the transparent ITO electrodes 514A, 516A becomes a joined shape of quadrangle and trapezoid.

Each of the metal electrodes 514B, 516B has a stripe pattern which has a narrower width than the transparent ITO electrodes 514A, 516A and is formed in the direction of a central portion of the transparent ITO electrodes 514A, 516A from a opposite sides of the transparent ITO electrodes 514A, 516A. Further, the metal electrodes 514B, 516B are made of material having a good conductivity in order to compensate a conductivity of transparent ITO electrodes 514A, 516A.

In the PDP according to the transformation of second embodiment of the present invention, the discharge starting voltage and discharge sustaining voltage are decreased and the brightness and efficiency are increased at this time of the discharge, although the contents of Xe inert gas increases. Further, as an area ratio of the transparent ITO electrodes 514A, 516A in comparison with a discharge cell is decreased, a consumption power is reduced and a radiation efficiency is improved.

Therefore, as shown in FIG. 13, a brightness of PDP according to a modification of the second embodiment is improved approximately 77% in comparison with the conventional PDP at a same discharge voltage. And as shown in FIG. 14, a efficiency of PDP according to the transformation of second embodiment is improved approximately 57% in comparison with the conventional PDP at a same discharge voltage.

FIG. 15 is a plane view illustrating a pair of sustain electrodes according to another modification of the second embodiment.

Sustain electrodes 614, 616 are consisted of transparent ITO electrodes 614A, 616A and metal electrodes 614B, 616B on the transparent ITO electrodes 614A, 616A. The transparent ITO electrodes 614A, 616A are opposite to each other at a predetermined distance.

The transparent ITO electrodes 614A, 616A have a stripe pattern of a wide width relatively and are made of transparent material in order to transmit a visible ray. And, each of the transparent ITO electrodes 614A, 616A is consisted of an upper portion of a first width and a lower portion of a second width. Namely, both edges are patterned in a shape of trapezoid. Wherein the pattern is a part which an influence of brightness is little. In result, each of the transparent ITO electrodes 614A, 616A becomes a joined shape of stripe and trapezoid.

Each of the metal electrodes 614B, 616B has a stripe pattern which has a narrower width than the transparent ITO electrodes 614A, 616A and is formed in the direction of a central portion of the transparent ITO electrodes 614A, 616A from a opposite sides of the transparent ITO electrodes 614A, 616A. Further, the metal electrodes 614B, 616B are made of material having a good conductivity in order to compensate a conductivity of transparent ITO electrodes 614A, 616A.

In the PDP according to another modification of second embodiment of the present invention, the discharge starting voltage and discharge sustaining voltage are decreased and the brightness and efficiency are increased at this time of the discharge, although the contents of Xe inert gas increases. Further, as an area ratio of the transparent ITO electrodes 614A, 616A in comparison with a discharge cell is decreased, a consumption power is reduced and a radiation efficiency is improved.

Therefore, a brightness and efficiency of PDP according to the other transformation of second embodiment is improved in comparison with the conventional PDP at a same discharge voltage.

The Third Embodiment

The description of the same elements with the first embodiment of the present invention shown in FIG. 3 is omitted.

FIG. 16 is a plane view illustrating a pair of sustain electrodes according to a third embodiment of the present invention.

Sustain electrodes 714, 716 are consisted of transparent ITO electrodes 714A, 716A, metal electrodes 714B, 716B and projecting metal electrodes 714C, 716C on the transparent ITO electrodes 714A, 716A. The transparent ITO electrodes 714A, 716A are opposite to each other at a predetermined distance.

The transparent ITO electrodes 714A, 716A have a stripe pattern of a wide width relatively and are made of transparent material in order to transmit a visible ray.

Each of the metal electrodes 714B, 716B has a stripe pattern which has a narrower width than the transparent ITO electrodes 714A, 716A and is formed in the direction of a central portion of the transparent ITO electrodes 714A, 716A from a opposite sides of the transparent ITO electrodes 714A, 716A. Further, the metal electrodes 714B, 716B are made of material having a good conductivity in order to compensate a conductivity of transparent ITO electrodes 714A, 716A.

Each of the projecting metal electrodes 714C, 716C is jutted in the direction of a verge of a discharge cell from a middle point of the metal electrodes 714B, 716B. Whereupon, the projecting metal electrodes 714C, 716C and the metal electrodes 714B, 716B become a "T" shape. The projecting metal electrodes 714C, 716C are made of material having a good conductivity in order to compensate a conductivity of transparent ITO electrodes 714A, 716A, and are expanded in the direction of the outside sides of the discharge cell.

Preferably, the position of each of the metal electrodes 714B, 716B satisfies the following the equation 4.

$$D<H/4 \qquad \text{[Equation 4]}$$

wherein H represents a length of discharge cell, D represents a distance between a central portion of the metal electrodes 714B, 716B and a central portion of the discharge cell.

In the PDP according to the third embodiment of the present invention, the discharge starting voltage and discharge sustaining voltage are decreased and the brightness and efficiency are increased at this time of the discharge, although the contents of Xe inert gas increases. Further, as an area ratio of the transparent ITO electrodes 714A, 716A in comparison with a discharge cell is decreased, a consumption power is reduced and a radiation efficiency is improved.

That is, since the distance between the metal electrodes 714B, 716B is near, the strong electric field generates at the central portion of the discharge cell, at this time of the discharge, and then the discharge is expanded in the direction of the verge of the discharge cell. In this result, the discharge starting voltage and discharge sustaining voltage are decreased by the generated strong electric field at the central portion of the discharge cell and the brightness and efficiency are increased. Furthermore, since the discharge starting voltage and the discharge delay time are decreased, the stability of the discharge is improved.

Therefore, as shown in FIG. 17, a brightness of PDP according to the transformation of third embodiment is improved approximately 40% to 50% in comparison with the conventional PDP at a same discharge voltage. And as shown in FIG. 18, an efficiency of PDP according to the transformation of second embodiment is improved approximately 30% to 40% in comparison with the conventional PDP at a same discharge voltage.

FIG. 19 is a plane view illustrating a pair of sustain electrodes according to a modification of the third embodiment.

Sustain electrodes 814, 816 are consisted of transparent ITO electrodes 814A, 816A, metal electrodes 814B, 816B, projecting metal electrodes 814C, 816C and auxiliary metal electrodes 814D, 816D on the transparent ITO electrodes 814A, 816A. The transparent ITO electrodes 814A, 816A are opposite to each other at a predetermined distance.

The transparent ITO electrodes 814A, 816A have a stripe pattern of a wide width relatively and are made of transparent material in order to transmit a visible ray.

Each of the metal electrodes 814B, 816B has a stripe pattern which has a narrower width than the transparent ITO electrodes 814A, 816A and is formed in the direction of a central portion of the transparent ITO electrodes 814A, 816A from a opposite sides of the transparent ITO electrodes 814A, 816A. Further, a position of the metal electrodes 814B, 816B satisfies the above equation 4 and the metal electrodes 814B, 816B are made of material having a good conductivity in order to compensate a conductivity of transparent ITO electrodes 814A, 816A.

Each of the projecting metal electrodes 814C, 816C is jutted in the direction of a verge of a discharge cell from a middle point of the metal electrodes 814B, 816B. Whereupon, the projecting metal electrodes 814C, 816C and the metal electrodes 814B, 816B become a "T" shape. The projecting metal electrodes 814C, 816C are made of material having a good conductivity in order to compensate a conductivity of transparent ITO electrodes 814A, 816A, and are expanded in the direction of the outside sides of the discharge cell.

Each of the auxiliary metal electrodes 814D, 816D is formed at a tip of the projecting metal electrodes 814C, 816C and formed in parallel to the metal electrodes 814B, 816B and is short than a length of the metal electrodes 814B, 816B. Whereupon, the metal electrodes 814B, 816B, the projecting metal electrodes 814C, 816C and the auxiliary metal electrodes 814D, 816D become a "H" shape. The auxiliary metal electrodes 814D, 816D are made of material having a good conductivity in order to compensate a conductivity of transparent ITO electrodes 814A, 816A, and are expanded in the direction of the outside sides of the discharge cell.

In the PDP according to a modification of third embodiment of the present invention, the discharge starting voltage and discharge sustaining voltage are decreased and the brightness and efficiency are increased at this time of the discharge, although the contents of Xe inert gas increases. Further, as an area ratio of the transparent ITO electrodes 814A, 816A in comparison with a discharge cell is decreased, a consumption power is reduced and a radiation efficiency is improved.

FIG. 20 is a plane view illustrating a pair of sustain electrodes according to another modification of the third embodiment.

Sustain electrodes 914, 916 are consisted of transparent ITO electrodes 914A, 916A, metal electrodes 914B, 916B, projecting metal electrodes 914C, 916C and auxiliary metal electrodes 914D, 916D on the transparent ITO electrodes 914A, 916A. The transparent ITO electrodes 914A, 916A are opposite to each other at a predetermined distance.

The transparent ITO electrodes 914A, 916A have a stripe pattern of a wide width relatively and are made of transparent material in order to transmit a visible ray.

Each of the metal electrodes 914B, 916B has a stripe pattern which has a narrower width than the transparent ITO electrodes 914A, 916A and is formed in the direction of a central portion of the transparent ITO electrodes 914A, 916A from a opposite sides of the transparent ITO electrodes 914A, 916A. Further, a position of the metal electrodes 914B, 916B satisfies the above equation 4 and the metal electrodes 914B, 916B are made of material having a good conductivity in order to compensate a conductivity of transparent ITO electrodes 914A, 916A.

Each of the projecting metal electrodes 914C, 916C is jutted in the direction of a verge of a discharge cell from a middle point of the metal electrodes 914B, 916B. Whereupon, the projecting metal electrodes 914C, 916C and the metal electrodes 914B, 916B become a "T" shape. The projecting metal electrodes 914C, 916C are made of material having a good conductivity in order to compensate a conductivity of transparent ITO electrodes 914A, 916A, and are expanded in the direction of the outside sides of the discharge cell.

Each of the auxiliary metal electrodes 914D, 916D is formed at a middle portion of the projecting metal electrodes 914C, 916C and formed in parallel to the metal electrodes 914B, 916B and is short than a length of the metal electrodes 914B, 916B. Whereupon, the metal electrodes 914B, 916B, the projecting metal electrodes 914C, 916C and the auxiliary metal electrodes 914D, 916D become a "±" shape. The auxiliary metal electrodes 914D, 916D are made of material having a good conductivity in order to compensate a conductivity of transparent ITO electrodes 914A, 916A, and are expanded in the direction of the outside sides of the discharge cell.

FIG. 21 is a plane view illustrating a pair of sustain electrodes according to the other modification of the third embodiment.

Sustain electrodes 1014, 1016 are consisted of transparent ITO electrodes 1014A, 1016A, metal electrodes 1014B, 1016B, projecting metal electrodes 1014C, 1016C and auxiliary metal electrodes 1014D, 1016D on the transparent ITO electrodes 1014A, 1016A. The transparent ITO electrodes 1014A, 1016A are opposite to each other at a predetermined distance.

The transparent ITO electrodes 1014A, 1016A have a stripe pattern of a wide width relatively and are made of transparent material in order to transmit a visible ray.

Each of the metal electrodes 1014B, 1016B has a stripe pattern has a narrower width than a wide of the transparent ITO electrodes 1014A, 1016A and is formed in the direction of a central portion of the transparent ITO electrodes 1014A, 1016A from an opposite sides of the transparent ITO electrodes 1014A, 1016A. Further, a position of the metal electrodes 1014B, 1016B satisfies the above equation 4 and the metal electrodes 1014B, 1016B are made of material having a good conductivity in order to compensate a conductivity of transparent ITO electrodes 1014A, 1016A.

Each of the projecting metal electrodes 1014C, 1016C is jutted in the direction of a verge of a discharge cell from a middle point of the metal electrodes 1014B, 1016B. Whereupon, the projecting metal electrodes 1014C, 1016C and the metal electrodes 1014B, 1016B become a "T" shape. The projecting metal electrodes 1014C, 1016C are made of material having a good conductivity in order to compensate a conductivity of transparent ITO electrodes 1014A, 1016A, and are expanded in the direction of the outside sides of the discharge cell.

Each of the auxiliary metal electrodes 1014D, 1016D has a first auxiliary metal electrode and a second auxiliary metal electrode. The first auxiliary metal electrodes is formed at a tip of the projecting metal electrodes 1014C, 1016C and formed in parallel to the metal electrodes 1014B, 1016B and is short than a length of the metal electrodes 1014B, 1016B. The second auxiliary metal electrodes is formed at a middle portion of the projecting metal electrodes 1014C, 1016C and formed in parallel to the metal electrodes 1014B, 1016B and is short than a length of the metal electrodes 1014B, 1016B. Whereupon, the metal electrodes 1014B, 1016B, the projecting metal electrodes 1014C, 1016C and the auxiliary metal electrodes 1014D, 1016D become a "∓" shape. The auxiliary metal electrodes 1014D, 1016D are made of material having a good conductivity in order to compensate a conductivity of transparent ITO electrodes 1014A, 1016A, and are expanded in the direction of the outside sides of the discharge cell.

In a plasma display panel according to the first embodiment of the present invention, a auxiliary metal electrode induces a strong electric field in the central portion of discharge cell and the discharge starting voltage and the discharge sustaining voltage are decreased. Therefore, the present invention has an effect that it can increase the brightness and efficiency at the same discharge voltage.

In a plasma display panel according to the second embodiment of the present invention, the discharge starting voltage and discharge sustaining voltage are decreased and the brightness and efficiency are increased at this time of the discharge, although the contents of Xe inert gas increases. Further, as an area ratio of the transparent ITO electrodes in comparison with a discharge cell is decreased, a consumption power is reduced and a radiation efficiency is improved.

In a plasma display panel according to the third embodiment of the present invention, since a distance between metal electrodes is near, the strong electric field generates at the central portion of the discharge cell and the discharge is expanded in the direction of the verge of the discharge cell by a auxiliary metal electrode. Therefore, the discharge starting voltage and discharge sustaining voltage are decreased and the brightness and efficiency are increased at the same discharge voltage. Furthermore, as the discharge starting voltage and the discharge delay time are decreased, the stability of the discharge is improved.

What is claimed is:

1. A plasma display panel comprising: transparent ITO electrodes which are spaced in parallel to each other at a predetermined distance within a discharge cell; metal electrodes which are formed on the transparent ITO electrodes and in parallel to the transparent ITO electrodes, wherein central portions of the metal electrodes are closer to a central portion of the discharge cell than central portions of the transparent ITO electrodes and wherein said metal electrodes satisfy: $d2<d1/2$, wherein d1 represents a distance from a central portion of said transparent ITO electrode to a central portion of said discharge cell, and d2 represents a distance from a central portion of said metal electrode to a central portion of said discharge cell.

2. The plasma display panel of claim 1, wherein the metal electrodes are formed on sides of the transparent ITO electrodes, respectively, wherein the sides are close to a central portion of the discharge cell.

3. The plasma display panel of claim 1, wherein a part of the metal electrodes is formed on sides of the transparent ITO electrodes, respectively, wherein the sides are close to a central portion of the discharge cell.

4. The plasma display panel of claim 1, further comprising:

a plurality of projecting metal electrodes formed to project away from the central portion of the discharge cell.

5. The plasma display panel of claim 4, wherein the plurality of projecting metal electrodes are connected with the metal electrodes.

6. The plasma display panel of claim 4, wherein the plurality of projecting metal electrodes are not connected with the metal electrodes.

7. A plasma display panel comprising: transparent ITO electrodes which are spaced in parallel to each other at a predetermined distance within a discharge cell and are patterned so that a part of said transparent ITO electrodes is different in width, respectively; and metal electrodes which are formed on said transparent ITO electrodes and in parallel to said transparent ITO electrodes so that are positioned in the direction of opposite sides of said transparent 1 TO electrodes, respectively, and wherein said metal electrodes satisfy: $d2<d1/2$ wherein d1 represents distance from a central portion of said transparent ITO electrode to a central portion of said discharge cell, and d2 represents distance from a central portion of said metal electrode to a central portion of said discharge cell.

8. The plasma display panel of claim 7, wherein said patterns are formed at both edges of the outside sides of said transparent ITO electrodes.

9. The plasma display panel of claim 8, wherein said patterns are polygonal shape.

10. The plasma display panel of claim 7, wherein said metal electrodes which are spaced in parallel to each other at a predetermined distance from the opposite sides of said transparent ITO electrodes, respectively.

11. The plasma display panel of claim 8, wherein said patterns are quadrangular shape.

12. The plasma display panel of claim 11, wherein said transparent ITO electrodes patterned in quadrangle satisfy:

$$0.2\times W1<W2<0.8\times W1,\ 0.2\times d3<d4<0.8\times d3$$

wherein W1 represents a horizontal length of the discharge cell, W2 represents a horizontal length of patterning portion of the transparent ITO electrodes, d3 represents a height of the transparent ITO electrodes, d4 represents a height of patterning portion of the transparent ITO electrodes.

13. The plasma display panel of claim 8, wherein said patterns are triangular shape.

14. The plasma display panel of claim 8, wherein said patterns are trapezoidal shape.

15. A plasma display panel comprising: transparent ITO electrodes which are spaced in parallel to each other at a predetermined distance within a discharge cell; metal electrodes which are formed on the transparent ITO electrodes and in parallel to the transparent ITO electrodes, wherein central portions of the metal electrodes are closer to a central portion of the discharge cell than central portions of the transparent ITO electrodes; and projecting metal electrodes which are jutted from the metal electrodes, respectively, and wherein said metal electrodes satisfy: $D<H/4$, wherein H represents a length of the discharge cell, and D represents a distance between a central portion of the metal electrode and a central portion of the discharge cell.

16. The plasma display panel of claim 15, wherein said projecting metal electrodes are jutted from a middle portion of said metal electrodes, respectively.

17. The plasma display panel of claim 14, further comprising:

auxiliary metal electrodes formed at a tip of said projecting metal electrodes and formed in parallel to said metal electrodes, respectively.

18. The plasma display panel of claim 17, wherein lengths of said auxiliary metal electrodes are shorter than said metal electrodes.

19. The plasma display panel of claim 14, further comprising:

auxiliary metal electrodes crossed at a middle portion of said projecting metal electrodes and formed in parallel to said metal electrodes, respectively.

20. The plasma display panel of claim 19, wherein lengths of said auxiliary metal electrodes are shorter than said metal electrodes.

21. The plasma display panel of claim 14, wherein first auxiliary metal electrodes are formed at a tip of said projecting metal electrodes and formed in parallel to said metal electrodes, respectively; and second auxiliary metal electrodes traverse a middle portion of said projecting metal electrodes and are formed in parallel to said metal electrodes, respectively.

22. The plasma display panel of claim 21, wherein lengths of said first and second auxiliary metal electrodes are shorter than said metal electrodes.

23. A plasma display panel comprising: metal electrodes formed in a discharge cell and formed to be close to a central portion of the discharge cell and wherein said metal electrodes satisfy: $d2<d1/2$, wherein d1 represents a distance from a central portion of said transparent ITO electrode to a central portion of said discharge cell, and d2 represents a distance from a central portion of said metal electrode to a central portion of said discharge cell.

24. The plasma display panel of claim 23, further comprising:

transparent ITO electrodes that are spaced in parallel to each other at a predetermined distance within the discharge cell.

25. The plasma display panel of claim 23, further comprising:

a plurality of projecting metal electrodes formed to project away from the central portion of the discharge cell.

* * * * *